United States Patent [19]

Wunner

[11] 4,322,956

[45] Apr. 6, 1982

[54] WARP KNITTING MACHINE ARRANGEMENT

[75] Inventor: Roland Wunner, Bernstein, Fed. Rep. of Germany

[73] Assignee: LIBA Maschinenfabrik GmbH, Naila, Fed. Rep. of Germany

[21] Appl. No.: 240,149

[22] Filed: Mar. 3, 1981

[30] Foreign Application Priority Data

Mar. 4, 1980 [DE] Fed. Rep. of Germany ..... 3008276

[51] Int. Cl.[3] ..... D04B 23/00; D04B 27/00

[52] U.S. Cl. ..... 66/203; 66/109

[58] Field of Search ..... 66/203, 109, 104

[56] References Cited

U.S. PATENT DOCUMENTS 3,006,172 10/1961 Porter ..... 66/109

4,202,185 5/1980 Lesley ..... 66/203

*Primary Examiner*—Ronald Feldbaum

*Attorney, Agent, or Firm*—O'Brien & Marks

[57] ABSTRACT

An arrangement for a warp knitting machine is disclosed as including individual sinkers movable between needles that hold a fabric, two right-angles sides of each sinker are disposed so that each knitted stitch now may be held away from the back of the needle.

5 Claims, 2 Drawing Figures

WARP KNITTING MACHINE ARRANGEMENT

BACKGROUND OF THE INVENTION

1. Field of the Invention

The present invention relates to a warp knitting machine arrangement and, more particularly, to such a machine which withdraws the fabric over an edge of the machine's knock-over bar.

2. Description of the Prior Art

The prior art is cognizant of a warp knitting machine with withdrawal of the fabric over a fixed knock-over edge of a knock-over bar and with a piercing comb consisting of single sinkers and movable to and fro between the needles which holds the fabric, with its lower edge extending approximately at right angles to the needles, in a specific position in relation to the knock-over edge.

Such a warp knitting machine is shown in German Pub. Spec. No. 2,127,970, which is incorporated herein by reference. The piercing comb prevents the loops from being entrained in the movement of the needles through the last-formed loops in each case, namely in the direction away from the knock-over edge, whereby defectively knitted goods could result. This action of the piercing comb is called holding down of the fabric.

The withdrawing of the finished fabric over the fixed knock-over edge has the consequence that the stitch loops can in each case draw thenselves tight round the needles, so that correspondingly tightly and firmly knitted fabric results. For this reason the type of this known machine is usable practically only for the production of a fabric of specific tightness and firmness.

SUMMARY OF THE INVENTION

The present invention is summarized in a warp knitting machine arrangement which withdraws a fabric over a fixed knock-over edge of a knock-over bar, has a piercing comb including individual sinkers movable to and fro between needles that hold the fabric, a needle slider for moving each needle and the sinker having a lower edge extending approximately at right angles to the needles in a specific position in relation to the knock-over edge, characterized in that the lower edge forms one side of an approximately right-angled recess which has another side on the sinker extending away from such lower edge and reaching at least to a level of the knock-over edge, and said another side being adjustable by adjusting the setting of said sinker relative to a back of said needle.

OBJECTS OF THE INVENTION

It is an object of the present invention to overcome the problems associated with the prior art warp knitting machines and to render such machines more universally usable.

This invention has another object in that the construction of a warp knitting machine is accomplished in a simple and efficient manner.

Other objects and advantages will become apparent from the following description taken in conjunction with the accompanying drawings.

DESCRIPTION OF THE PREFERRED EMBODIMENT

In accordance with the present invention the prior art warp knitting machines are substantially improved for universal use in that the lower edge of each individual sinker forms the one side of an approximately right-angled recess the other side of which, extending away from the lower edge, reaches at least to the level of the knock-over edge and is adjustable so that the stitch row just knitted in each case can be held away from the needle back.

This configuration of the sinkers of the piercing comb gives them the possibility not only of holding down the fabric but also furthermore of pressing the stitch row just knitted away more or less from the needle backs whereby, according to the setting of the piercing comb, the side extending away from the lower edge in each case exerts a more or less great pressure upon the fabric in the direction away from the needles. As a result of this different pressure stitch loops of different sizes in each case develop around the individual needles, whereby fabric of correspondingly different firmness results.

The length of the side extending away from the lower edge and reaching at least to the level of the knock-over edge here ensures that in each case stitches just knitted cannot slip away from the side extending away from the lower edge. If this length were not adequate, the danger would exist that stitches just knitted would still tighten around the needles immediately above the knock-over edge, whereby the mentioned recess with its two sides would remain ineffective.

The side extending away from the lower edge of the sinkers of the piercing comb can advantageously be formed as a nose. It is however also possible for this side to be formed directly by the carrier shank of the sinkers. In both cases the piercing comb presses with the relevant side, the nose or the carrier shank of the sinker, against the stitch row just knitted in each case and then by reason of its setting ensures the knitting of more or less firm fabric.

In order to obtain accessibility of the bar for the needles and for the sliders in the case of use of slider needles, the bar for the piercing comb is expediently arranged between the fixed knock-over bar and the bar for the needles. In this case the individual sinkers of the piercing comb extend through the needles. In this way the object is achieved that the bars for the needles and the sliders are not covered, from the side of the sliders, by the bar for the piercing comb.

So that now the possibility is retained of replacing the piercing comb or parts thereof in a simple manner, apertures are provided in the knock-over bar before securing elements for the piercing comb. By reason of these apertures, fastening elements, for example screws, on the bar for the piercing comb remain freely accessible.

Figure 1:
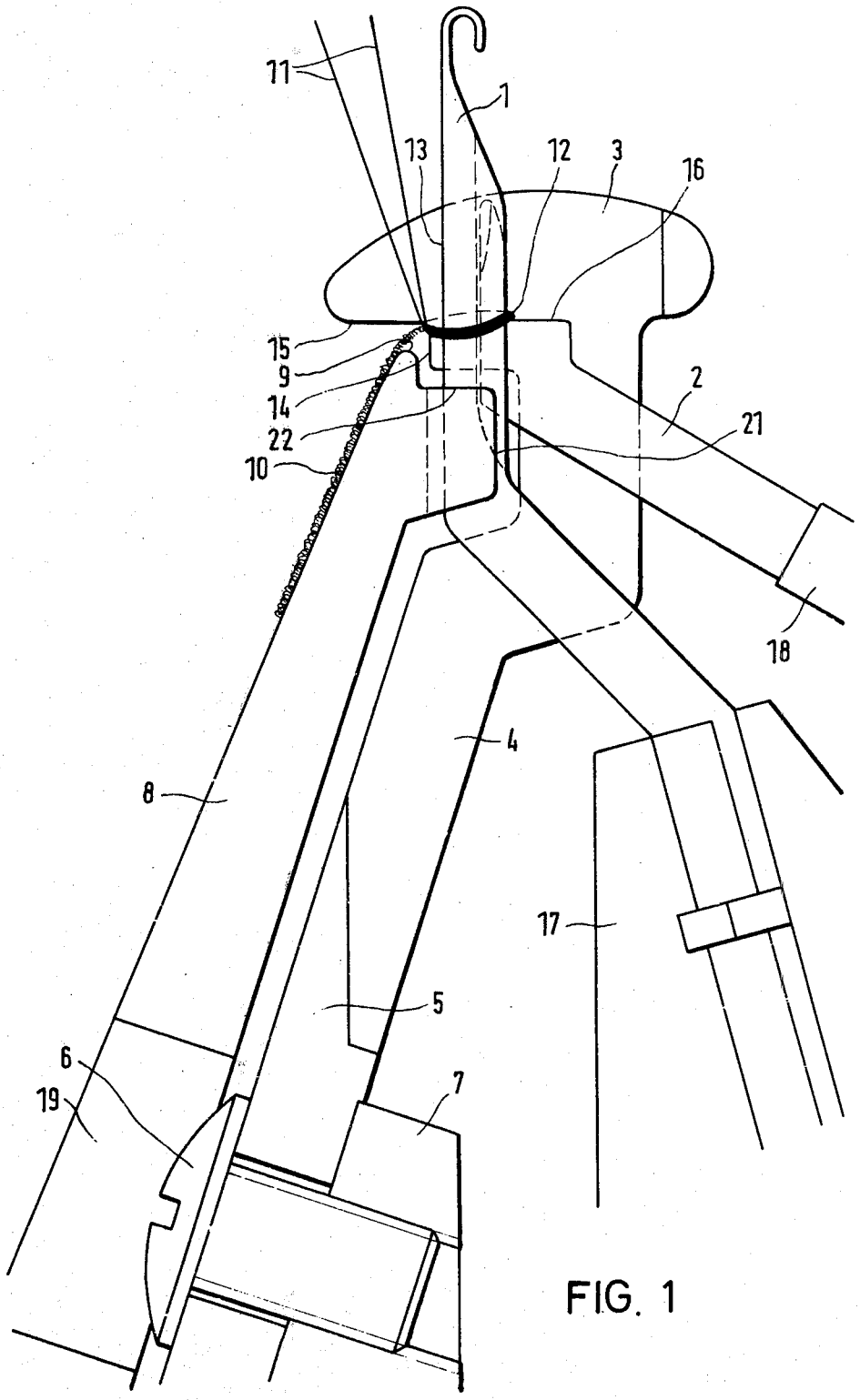
FIG. 1 is a schematic diagram illustrating the slider needle arrangement of a warp knitting machine embodying the present invention.

The part of a warp knitting machine with piercing comb which is of interest in this connection is illustrated in FIG. 1. The slider needle 1 with its slider 2 is shown. These two components are actuated in known manner. Moreover a sinker 3 of the piercing comb is illustrated. Each sinker 3 is seated on the sinker shank 4, which together with the sinker shanks of adjacent sinkers merges into the sinker mounting 5. The individual sinker mountings 5 are then secured on the sinker bar 7 by means of the screw 6. The sinker 3 is emphasized by heavier lines.

The sinker 3 carries out a reciprocating movement transversely of the longitudinal direction of the needle 1, which movement is imparted in known manner to the sinker through the sinker bar 7, similarly to the case of the needle 1 and the slider 2.

The knock-over bar 8 with its knock-over edge 9, over which the completed knitted fabric 10 is withdrawn, is fitted laterally beside the sinker shank 4. The fabric is knitted from the warp threads 11 which are illustrated drawn together into the stitch loop 12 in FIG. 1. The stitch loop 12 is shown laid around the shank of the needle 1.

As FIG. 1 shows, the stitch 12 is not drawn closely around the shank of the needle 1, rather the stitch 12 is held away from the needle back 13, namely by the nose 14 which extends approximately at right angles away from the lower edge 15 of the sinker 3 and together with this lower edge 15 forms a substantially right-angled recess with two sides, of which the one constitutes the lower edge 15 and the other the nose 14. Each last-formed stitch row is guided by this recess, namely by the lower edge 15 so that the stitch 12 cannot slip away upwards (holding down) and by the nose 14 so that the stitch 12 cannot be pulled to the needle back 13. Thus here the sinker 3 exercises a double function. In this context it is essential that, due to the optional setting imparted to it through the actuation of the sinker bar 7, the sinker 3 with its nose 14 ensures that in each case the desired size of the loops 12 is knitted, while the nose 14 in each case assumes a position lying more or less far from the needle back, in the operational phase as illustrated.

Thus it is possible on the one hand to work the machine without contact between the nose 14 and the stitch 12, that is not to permit the nose 14 to protrude before the needle back 13, whereby stitches 12 drawing closely around the shank of the needle 1 would form, which would then be produced by the machine as especially firm fabric. On the other hand however, the movement of the sinker 3 can also be adjusted so that, as illustrated, larger stitches 12 result, whereby a correspondingly less firm fabric is produced. The stroke and position in each case of the sinker 3 can be adjusted with known means by the actuating mechanism for the sinker bar 7.

As may be seen, the stitch 12 lies with its side remote from the needle back 13 upon a protuberance 16 of the slider 2. This protuberance 16, together with the sinker 3, ensures a defined position of the stitches 12 on the needle 1.

In FIG. 1 it is also illustrated that the sinker shank 4 is conducted laterally past the needle 1 and the slider 2, thus it extends through between these components. This is attributable to the fact that the bar 7 for the piercing comb with the sinkers 3 is arranged between the knock-over bar 8 and the bar 17 for the needles 1. Thus the object is achieved that the space to the right above the slider mountings 18, which merge into the slider bar (not shown), remains free so that in the arrangement as illustrated it is also easily possible to replace needle 1 or slider 2. Moreover this arrangement results in better accessibility and clarity of lay-out of the working station, so that in the case of a thread breakage it is also easier to thread in a new thread.

So that now even in the case of a replacement of a sinker (together with the sinker mounting 5) the relevant securing screw 6 remains easily accessible, in the knock-over bar 8 before each screw 6 a piercing or opening 19 is provided. A screwdriver for example can easily be guided through the piercing or opening 19 in order to release the screw 6.

The protuberance 21 protrudes from the knock-over bar 8 laterally beside the knock-over edge 9, a plurality of such protuberances 21 being situated side by side in the arrangement as a whole. Thus a comblike arrangement of protuberances 21 engaging in the interspaces between the needles 1 results. This arrangement known per se ensures that when the needle 1 is drawn out of the stitch 12 the latter, if it is then at the same time drawn downward, can travel only a short distance, namely as far as the edge 22 of the stop 21. Consequently it is not possible for a stitch 12 to be drawn far downwards behind the knock-over edge 9.

Figure 2:
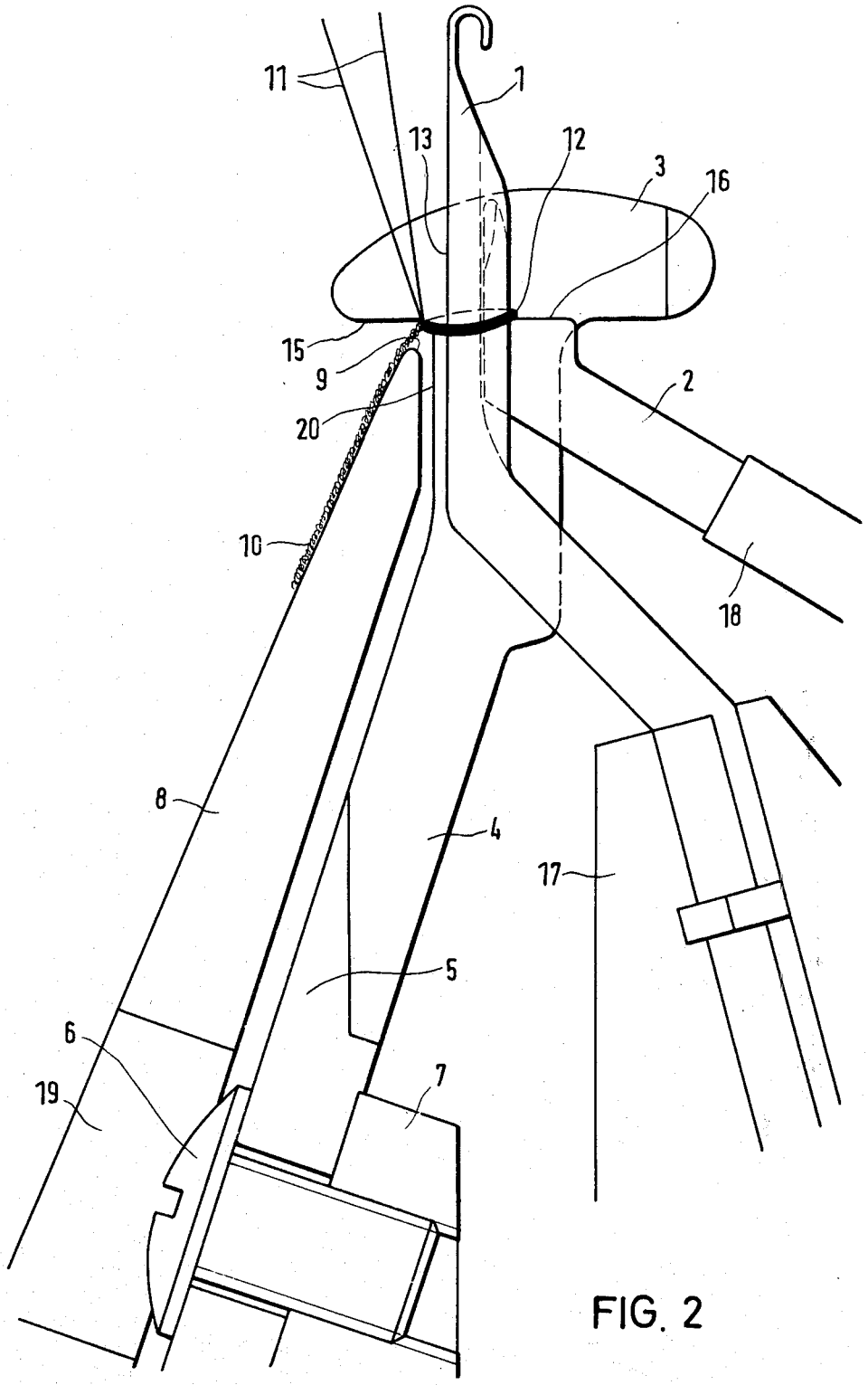
FIG. 2 is a schematic diagram similar to FIG. 1 but showing a modified form thereof.
Figure 1:
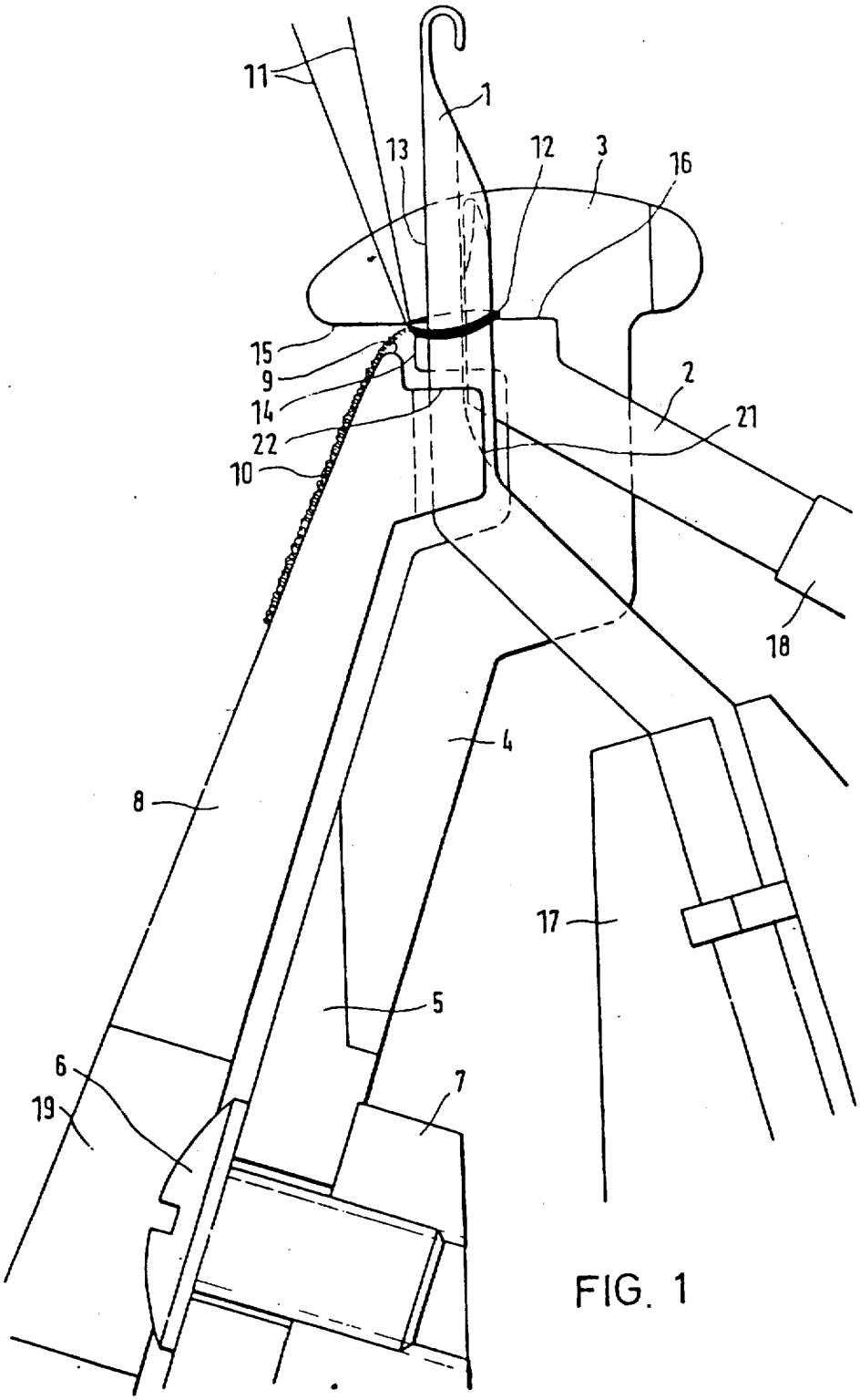
Figure 2:
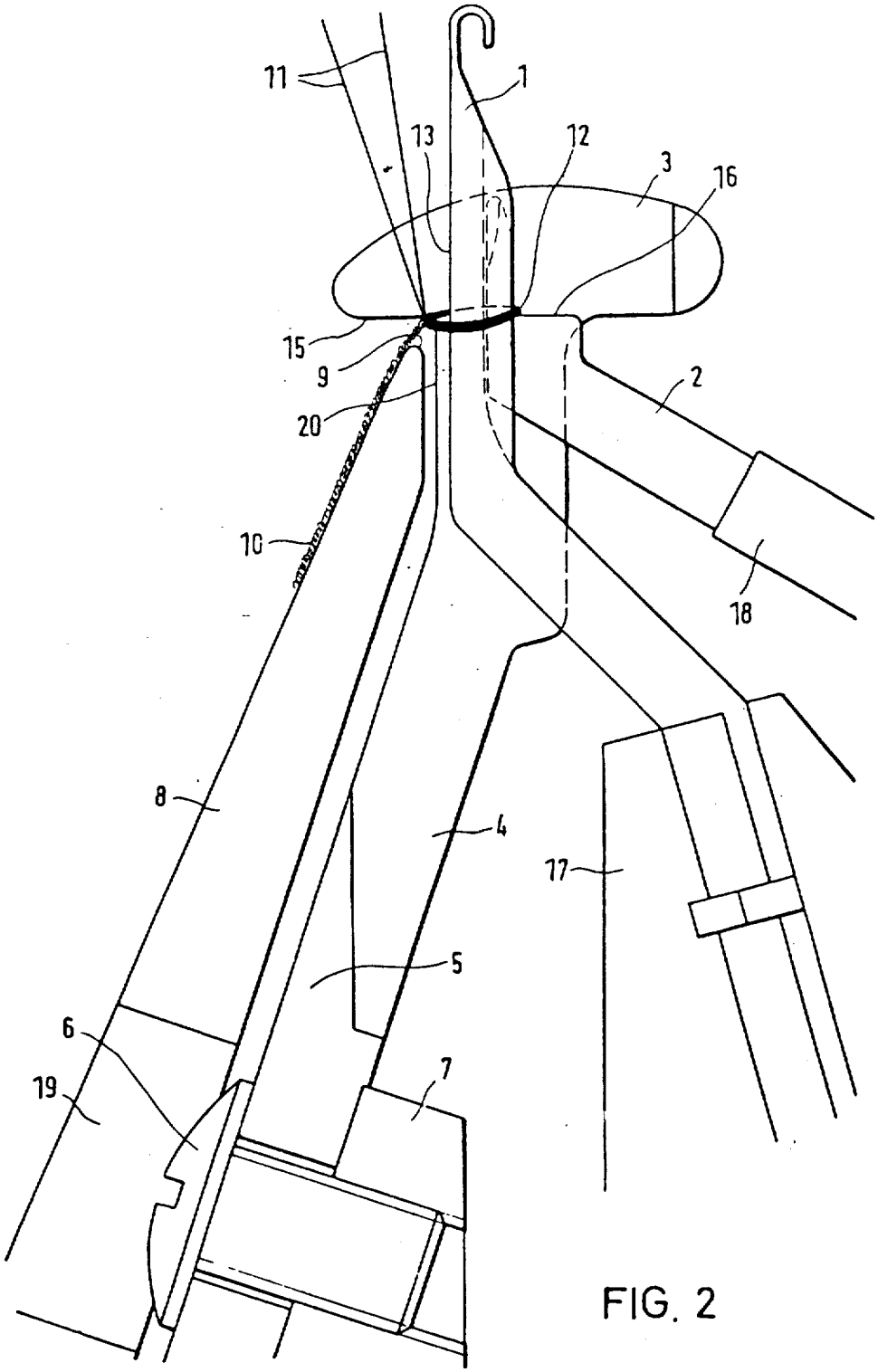

In FIG. 2 there is illustrated a variant of the form of embodiment according to FIG. 1, which differs from FIG. 1 only as regards the configuration of the sinker shank 4. The other components are the same as represented in FIG. 1, so that in this connection reference can be made to FIG. 1.

As may be seen, in FIG. 2 the side extending away from the lower edge 15 is formed directly by the sinker shank 4, namely by its forward edge 20, which thus corresponds to the nose 14 according to FIG. 1.

It should also be pointed out that the mechanism for the reciprocating movement of the sinker 3 naturally can also be so arranged that it lies to the right above the slider mounting 18. In this case admittedly the accessibility of the slider mounting 18 suffers, which however is no problem when the mechanism for the actuation of the sinkers 3 can easily be hinged away.

Inasmuch as the present invention is subject to many modifications, alterations and changes in details, it is intended that all matter contained in the foregoing description or shown on the accompanying drawings shall be interpreted as illustrative and not in a limiting sense.

What is claimed is:

1. A warp knitting machine arrangement which withdraws a fabric (10) over a fixed knock-over edge (9) of a knock-over bar (8), has a piercing comb including individual sinkers (3) movable to and fro between needles (1) that hold the fabric, a needle slider for moving each needle, said sinker (3) having a lower edge (15) extending approximately at right angles to the needles (1) in a specific position in relation to the knock-over edge (9), characterized in that the lower edge (15) forms one side of an approximately right-angled recess which has another side (14 or 20) on said sinker (3) extending away from such lower edge (15) and reaching at least to a level of the knock-over edge (9), and said another side (14) being adjustable by adjusting the setting of said sinker (3) relative to a back (13) of said needle (1).

2. A warp knitting machine arrangement according to claim 1, characterized in that the side extending away from the lower edge (15) forms a nose (14).

3. A warp knitting machine arrangement according to claim 1, characterized in that the side extending away from the lower edge (15) is formed by a side (20) on a carrier of the sinker (3).

4. A warp knitting machine arrangement according to one of claims 1, 2 or 3, characterized in that the bar (7) for the piercing comb is arranged between the knock-over bar (8) and the bar (17) for the needles (1).

5. A warp knitting machine arrangement according to claim 4, characterized in that openings (19) are provided in the knock-over bar (8) in front of securing elements (6) for the piercing comb.

* * * * *

UNITED STATES PATENT AND TRADEMARK OFFICE

CERTIFICATE OF CORRECTION

PATENT NO. : 4,322,956

DATED : April 6, 1982

INVENTOR(S) : Roland Wunner

It is certified that error appears in the above-identified patent and that said Letters Patent is hereby corrected as shown below:

The title page showing the illustrative figure should be deleted to appear as per attached page.

The sheets of drawings consisting of Figs. 1 and 2 should be deleted to be replaced with the two (2) sheets of drawings as shown on the attached sheets.

Signed and Sealed this

*Twenty-third* Day of *July 1985*

[SEAL]

*Attest:*

DONALD J. QUIGG

*Attesting Officer* *Acting Commissioner of Patents and Trademarks*

United States Patent [19]

Wunner

[11] 4,322,956

[45] Apr. 6, 1982

[54] WARP KNITTING MACHINE ARRANGEMENT

[75] Inventor: Roland Wunner, Bernstein, Fed. Rep. of Germany

[73] Assignee: LIBA Maschinenfabrik GmbH, Naila, Fed. Rep. of Germany

[21] Appl. No.: 240,149

[22] Filed: Mar. 3, 1981

[30] Foreign Application Priority Data

Mar. 4, 1980 [DE] Fed. Rep. of Germany ..... 3008276

[51] Int. Cl.[3] ..... D04B 23/00; D04B 27/00

[52] U.S. Cl. ..... 66/203; 66/109

[58] Field of Search ..... 66/203, 109, 104

[56] References Cited

U.S. PATENT DOCUMENTS 3,006,172 10/1961 Porter ..... 66/109

4,202,185 5/1980 Lesley ..... 66/203

*Primary Examiner*—Ronald Feldbaum

*Attorney, Agent, or Firm*—O'Brien & Marks

[57] ABSTRACT

An arrangement for a warp knitting machine is disclosed as including individual sinkers movable between needles that hold a fabric, two right-angles sides of each sinker are disposed so that each knitted stitch now may be held away from the back of the needle.

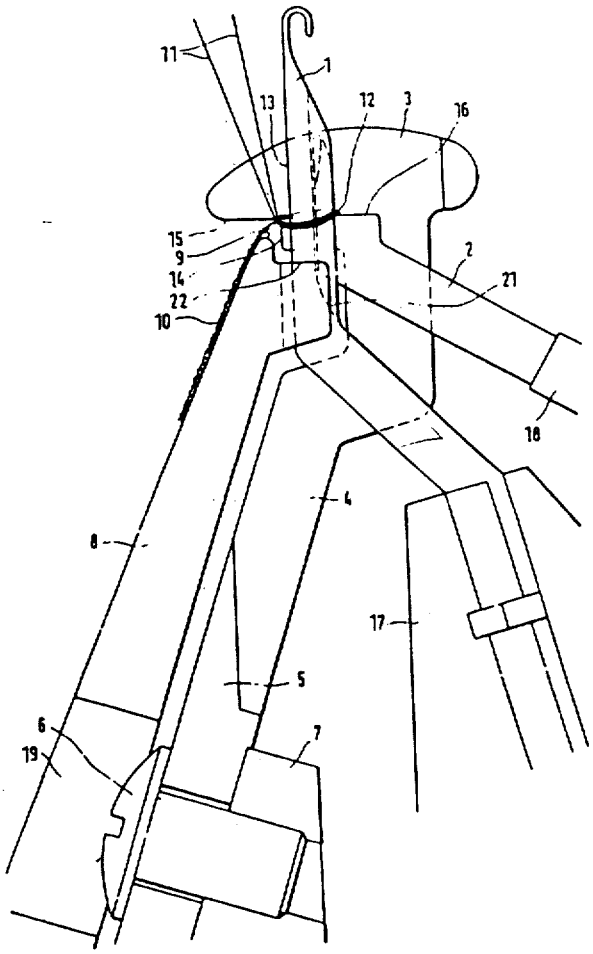

5 Claims, 2 Drawing Figures